United States Patent [19]

Brock

[11] 4,168,930

[45] Sep. 25, 1979

[54] REAR-LOADING SIDE-DUMPING SLAG POT CARRIER

[76] Inventor: Gibson E. Brock, R.D. #5, Persimmon Rd., Sewickley, Pa. 15143

[21] Appl. No.: 879,612

[22] Filed: Feb. 21, 1978

Related U.S. Application Data

[63] Continuation of Ser. No. 717,646, Aug. 25, 1976, abandoned.

[51] Int. Cl.[2] ..... B65G 65/36

[52] U.S. Cl. ..... 414/421; 294/73; 414/501; 414/592

[58] Field of Search ..... 214/518, 75 H, 318, 214/75 R, 315, 313, 314, 130 A; 212/11, 14, 18, 78, 130, 136, 137; 294/67 DC, 73; 266/142, 143, 276

[56] References Cited

U.S. PATENT DOCUMENTS

| | | | |
|---|---|---|---|
| 3,487,957 | 1/1970 | Brewer | 212/130 X |
| 3,825,135 | 7/1974 | Kress | 214/313 |
| 3,897,881 | 8/1975 | Brock | 294/73 X |

FOREIGN PATENT DOCUMENTS

| | | | |
|---|---|---|---|
| 1307168 | 9/1962 | France | 214/314 |

*Primary Examiner*—Frank E. Werner
*Attorney, Agent, or Firm*—Buell, Blenko & Ziesenheim

[57] ABSTRACT

The apparatus to be described comprises a trolley and track disposed crosswise of the carrying vehicle positioned between its front and rear wheels and elevated above the vehicle frame. At an end of the trolley track a cradle is affixed so as to tilt about a horizontal axis normal to the track. The trolley is provided with lifting hooks adapted to engage the trunnions of a slag pot resting on the ground and lift it above the vehicle frame. The cradle is provided with upstanding hooks which receive the slag pot trunnions when the pot is moved by the trolley into the cradle. Means are provided to tilt the cradle. The cradle frame is open toward the trolley so that the cradle partially encloses the slag pot during the dumping operation. The vehicle frame is of the fork or wishbone type open at the rear so that the vehicle can be backed to enclose a slag pot resting on the ground.

8 Claims, 10 Drawing Figures

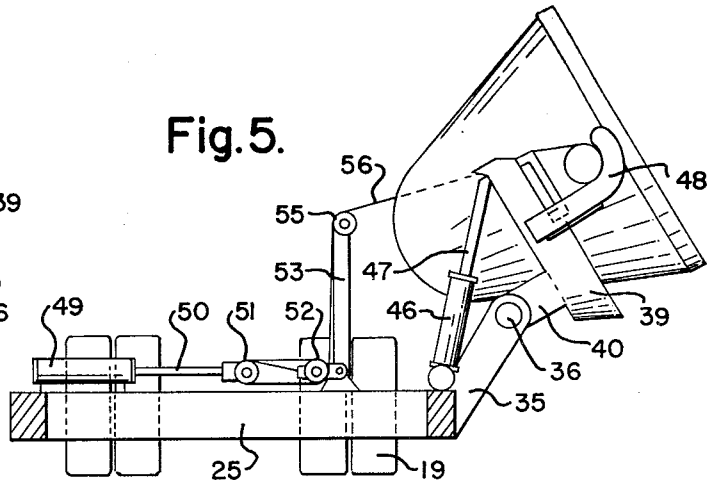
Fig. 5.
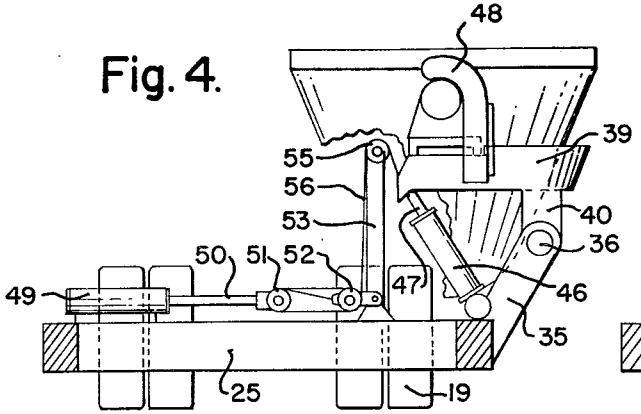
Fig. 4.
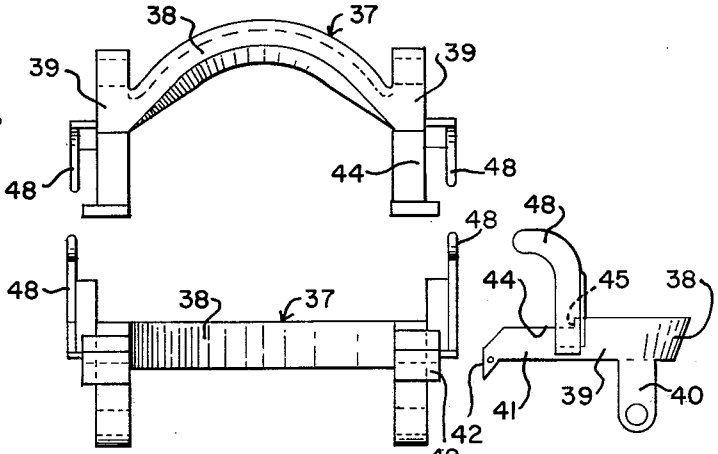
Fig. 6.
Fig. 7.
Fig. 8.
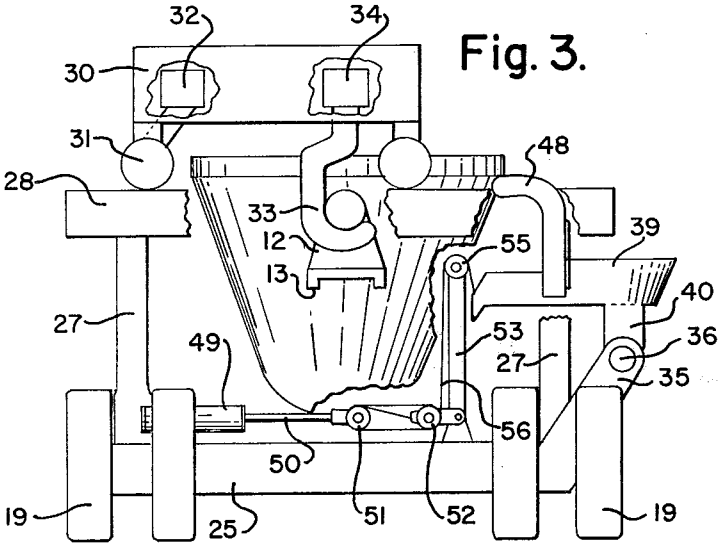
Fig. 3.

REAR-LOADING SIDE-DUMPING SLAG POT CARRIER

This is a continuation, of application Ser. No. 717,646, filed Aug. 25, 1976, now abandoned.

This invention relates to apparatus for in-plant roadway transport and dumping of slag pots and the like. It is more particularly concerned with such apparatus which is backed around a slag pot to pick it up, but dumps the pot broadside of the carrying vehicle.

RELATED PATENT

The apparatus of my invention is similar in some respects to that of my U.S. Pat. No. 3,897,881, but is different in other respects.

THE PROBLEM AND THE PRIOR ART

Apparatus for the rear loading and dumping of slag pots and the like is known and is described in my U.S. Pat. No. 3,863,791, Kress U.S. Pat. Nos. 3,446,378 and 3,825,135, Sjostrom, U.S. Pat. No. 3,922,720, and Miller U.S. Pat. No. 3,446,378, for example. One drawback of such apparatus is that a disproportionately large fraction of the load weight is carried by the rear wheels. It is also somewhat difficult to secure the slag pot during the dumping operation. Those drawbacks are not present in the apparatus of my U.S. Pat. No. 3,897,881 above mentioned. In that apparatus the slag pot is carried between the front and rear wheels of the vehicle and is both picked up and loaded broadside of the vehicle. It is advantageous to dump the slag pot from the side rather than the rear of the carrying vehicle, in several respects, a principal one being that the hot slag is not poured out adjacent the rubber-tired wheels of the vehicle. In some steel making shops, however, the floor layouts makes it more convenient to load the slag pots from the rear of the vehicle than from the side, and this advantage is present in the apparatus to be described hereinafter.

SUMMARY OF THE INVENTION

It is an object of my invention to provide slag transport apparatus in which the load is distributed relatively evenly between front and rear wheels. It is another object to provide such apparatus employing a plurality of wheels in tandem both at front and rear. It is still another object to provide such apparatus with positive means for holding the slag pot during the dumping operation. Other objects of my invention will appear in the course of the description thereof which follows.

My apparatus to be described comprises a trolley and track disposed crosswise of the carrying vehicle positioned between its front and rear wheels and elevated above the vehicle frame. At an end of the trolley track a cradle is affixed so as to tilt about a horizontal axis normal to the track. The trolley is provided with lifting hooks adapted to engage the trunnions of a slag pot resting on the ground and lift it above the vehicle frame. The cradle is provided with upstanding hooks which receive the slag pot trunnions when the pot is moved by the trolley into the cradle. Means are provided to tilt the cradle. The cradle frame is open toward the trolley so that the cradle partially encloses the slag pot during the dumping operation. The vehicle frame is of the fork or wishbone type open at the rear so that the vehicle can be backed to enclose a slag pot resting on the ground.

DESCRIPTION OF DRAWINGS

Embodiments of my invention presently preferred by me are illustrated in the attached Figures, to which reference is now made:

FIG. 3 is a rear end elevation of the apparatus of FIG. 1, partly broken away.

FIG. 4 is a cross section of a portion of my trailer apparatus as shown in FIG. 2 taken on the plane IV—IV of that Figure.

FIG. 5 is a like cross section of my apparatus as shown in FIG. 2, but with the cradle and slag pot in the dumping position.

FIG. 6 is a detail in plan of the cradle.

FIG. 7 is a side elevation of the cradle of FIG. 6.

FIG. 8 is a rear elevation of the cradle of FIG. 6.

DETAILED DESCRIPTION; FIRST EMBODIMENT

Figures 1, 2:
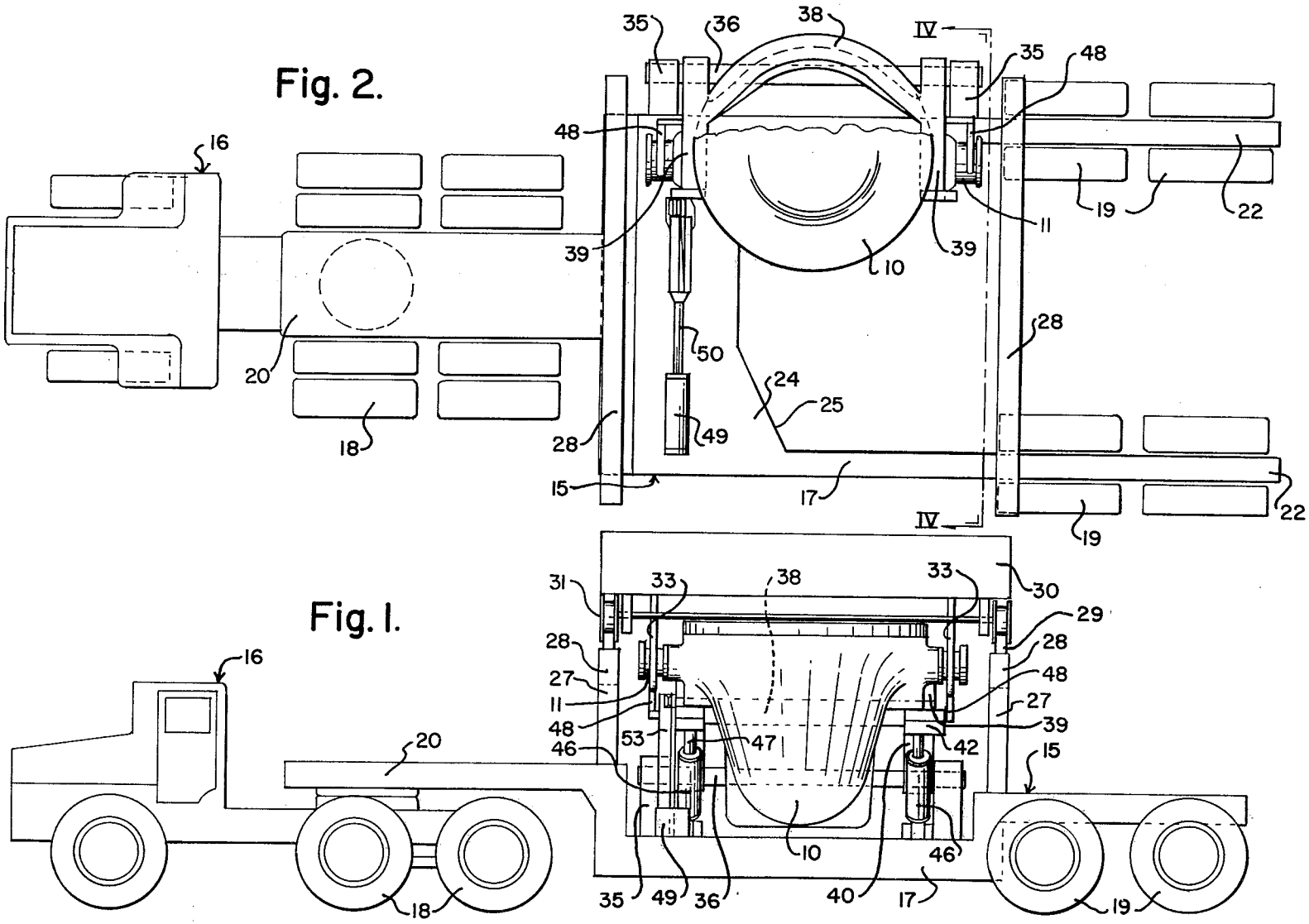
FIG. 1 is a side elevation of a first embodiment of my invention showing the slag pot in travelling position.
FIG. 2 is a plan view of the apparatus of FIG. 1 with the trolley removed, the slag pot broken away, and the cradle in position to dump.

My apparatus is suitable for conventional slag pots of any design. It is here described and illustrated in connection with a conventional slag pot 10 of circular plan and tapering outwardly from base to top provided with a pair of trunnions 11 along a pot diameter (FIG. 1). The trunnions project from the conical pot wall as bosses 12, each of which has a bottom face 13 adapted to rest on a flat horizontal surface.

In its first embodiment, shown in FIGS. 1 and 2, my apparatus to be described is carried by a wheeled trailer vehicle 15 pulled by a conventional multiple axle tractor 16. Trailer 15 is of the low-boy type, so called, comprising a load-carrying center bed section 17 positioned between the rear wheels 18 of the tractor and wheels 19 of trailer 15 at a level approximately that of the axles of wheels 19. The front end of center bed section 17 is affixed to a front end element 20 which is pivotally supported on tractor 16 in a known manner. The rear end of center bed section 17 is affixed at each side to a draft beam 22, and each draft beam 22 is supported by at least one pair of wheels 19, at least one wheel mounted on each side of the beam. No axle connects the pair of wheels 19 on one side of trailer 15 with the corresponding pair on the other side, nor does any structural member connect draft beams 22 except as is hereinafter described.

The front end of center bed section 17 is braced by a floor structure 24 affixed to both side members thereof. The rear edge 25 of structure 24 is cut away so that the structure 24 extends further toward the rear of center bed section 17 along its sides than it does in the middle, for a purpose also to be described.

At each end of center bed section 17 uprights 27 on each side support an elevated transverse trolley rail beam 28, which extends somewhat beyond draft beams 22 on each side of trailer 15. A trolley 30 runs on double flanged wheels 31 along rails 29. Trolley 30 is provided with means 32 for propelling it along rails 29, and also with hoisting means 34. Those means are adapted to raise and lower a pair of hooks 33 contoured to lift slag pot 10 by its trunnions 11.

On one side of center bed section 17 a pair of brackets 35 affixed thereto and extending outwardly thereof journal a horizontal shaft 36 parallel to the side of trailer 15. Affixed to shaft 36 between brackets 35 is a cradle 37 comprising an outwardly bowed cross member 38 and a pair of parallel side members 39, one affixed to each end of cross member 38 (FIGS. 6–8). The ends of arms 39 adjoining yoke 38 are formed into short downwardly projecting legs 40, the lower ends of which are attached to shaft 36. The inner ends 41 of side members 39 end in lugs 42 inclined downwardly therefrom at an obtuse angle. The upper surface 44 of each end 41 is flat and formed with an upstanding shoulder 45 intermediate its length. Pivotally attached at their lower ends to one side of center bed section 17 below cradle 37 are two hydraulic cylinders 46, one under each side member 39 of that cradle. A piston rod 47 projects from the upper end of each cylinder 46 and, when cradle 37 is horizontal, rests against the under side of lug 42 but is not attached thereto. Affixed to the outside face of each side member 39 and projecting upwardly therefrom is an inverted hook 48 contoured to fit over a slag pot trunnion 11, and spaced apart from each other a distance sufficient to span the slag pot and fit over its trunnions when the slag pot is resting in cradle 37.

A hydraulic cylinder 49 is mounted on floor structure 24 transversely thereof at its forward end. Its piston rod 50 is attached to one block 51 of a conventional block and tackle arrangement. The other block 52 is affixed to the foot of an upright member 53 which is also mounted on the floor structure 24 spaced from cylinder 49 (FIGS. 3–5). The upper end of member 53 carries a pulley 55. The free end of cable 56 from block 52 is trained over pulley 55 and attached to side member 39 of cradle 37 nearer the front end of trailer 15.

OPERATION OF FIRST EMBODIMENT

The clear open space between opposite inside wheels 19 of my trailer 15 is greater than the width of the slag pots to be accommodated. The clearance above ground of beams 28 is also greater than the height of a slag pot resting on the ground. Thus, trailer 15 is backed over a full slag pot by tractor 16 until hooks 33 carried by trolley 30 are aligned lengthwise of trailer 15 with the trunnions of the slag pot. The cut-out inside face 25 of floor structure 24 is contoured to clear the slag pot in this position. Hoist 34 is then operated to lower hooks 33 and trolley 30 is moved by its driving means 32 until the slag pot trunnions are within hooks 33. The slag pot is then lifted by hoist 34 to its traveling position above center bed section 17 of trailer 15.

When the apparatus arrives at the slag dump, trolley drive 32 is operated to move trolley 30 and the slag pot suspended therefrom along rails 29 to its position in cradle 37, as shown in FIG. 4. The bottom faces 13 of trunnion bosses 12 rest on upper surfaces 44 of side members 39 of cradle 37, against shoulders 45. The open side of hooks 33 and hook members 48 of cradle 37 face each other, and the respective hooks are offset from each other longitudinally of the trailer so that trolley 30 automatically moves the slag pot into position on cradle 37 with its trunnions within hooks 48. The depth of hooks 33 is made sufficiently great that they can be lowered after the slag pot is set in cradle 37, and withdrawn by reversing the movement of trolley 30.

The slag pot is dumped by actuating hydraulic cylinders 46. Their piston rods 47 raise the inside ends of side members 39, causing cradle 37 and the slag pot to pivot around shaft 36. That shaft is parallel to the axis of slag pot trunnions 11 but outboard thereof, and consequently the slag pot is tilted to pour its contents well beyond the side of trailer 15. As cradle 17 is tilted the center of gravity of the loaded slag pot moves outwardly until the balance point is passed, and the tilting of the pot is then caused by gravity. The stroke of cylinders 46 need only be long enough, therefore, to tilt cradle 17 just beyond that balance point, and contact between piston rods 47 and side arms 39 of cradle 37 ceases beyond that point. Cylinders 46 then rest against stops 43. As cradle 37 tilts outwardly, it pulls cable 56 and the continued tilting of cradle 37 is controlled by admitting hydraulic fluid to the piston rod end of hydraulic cylinder 49 so as to restrain cable 56. In the fully dumped position of the slag pot, (FIG. 10) cradle 37 is rotated through considerably more than 90°. The slag pot is prevented from falling out of cradle 37, however, by the upstanding hook elements 48. After the pot is dumped it is rapped against the ground by pulling back and then releasing cable 56, and the cradle 37 and empty pot are righted by operating hydraulic cylinder 49 to pull back cable 56. When the cradle tilts back to a position with the lugs 42 again engaging the outer ends of piston rods 47, they push down on those piston rods and the righting of cradle 37 from then on is controlled by releasing hydraulic fluid from lower ends of cylinders 46.

DETAILED DESCRIPTION; SECOND EMBODIMENT

Figure 10:
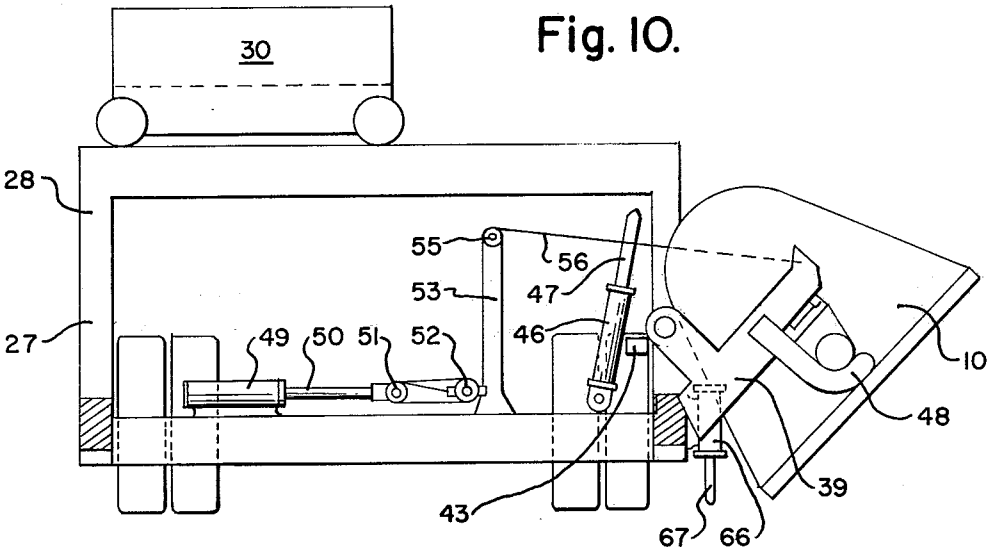
FIG. 10 is an end elevation of the apparatus of FIG. 9 showing the slag pot in its fully dumped position.
Figure 9:
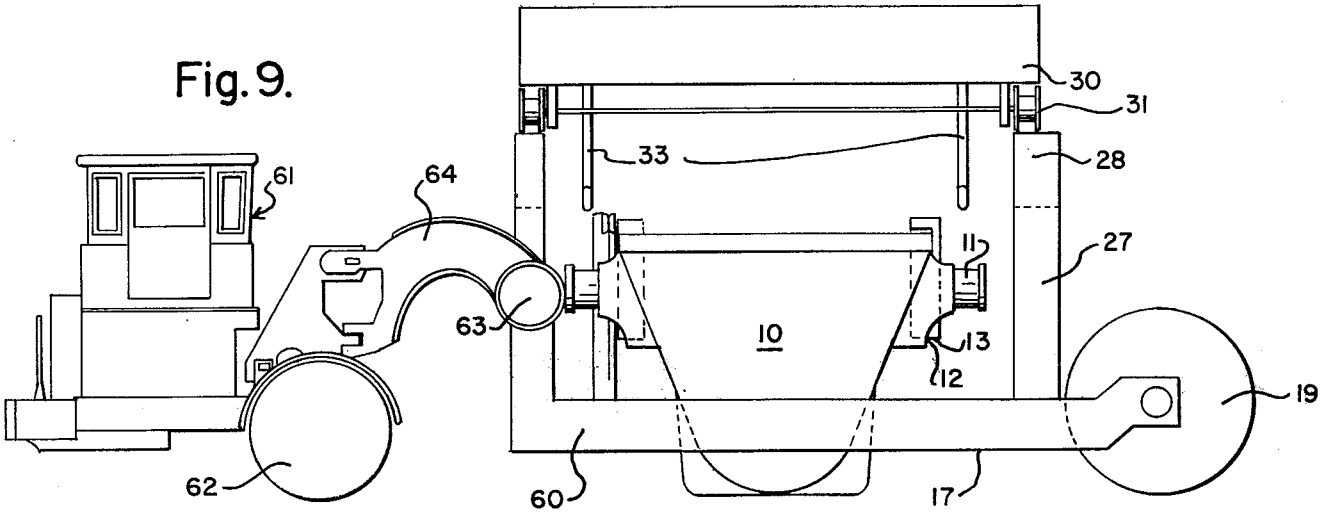
FIG. 9 is a side elevation of a second embodiment of my invention showing the slag pot resting on the ground ready to be picked up.

The second embodiment of my invention is shown in FIGS. 9 and 10. It differs from the first embodiment above described only in the structure of the carrying vehicle. My apparatus identical with that previously described, and identified in FIGS. 9 and 10 with the same reference characters previously used, is carried by a wheeled trailer vehicle 60 powered by a conventional single-axle tractor 61. Trailer 60 has a load-carrying center bed section 17 positioned between the wheels 62 of tractor 61 and wheels 19 of trailer 60 at a level approximately that of the axles of wheels 19. The front end of center bed section 17 is affixed to a transverse torque tube 63 from which a centrally positioned forwardly projecting goose neck 64 is pivotally connected to trailer 61 in conventional fashion, so as to provide for steering of the tractor-trailer combination. As shown in the figures, trailer 60 is not provided with tandem rear wheels 19. It is not believed necessary to describe this embodiment further or to set out its operation, which is the same as that of my first embodiment. Trailer 60 is shown as being provided with conventional outriggers on its dumping side, comprising vertical hydraulic cylinders 66 affixed to trailer 60 with downwardly extending piston rods 67. Those piston rods are normally retracted, but are extended to the ground when the slag pot is to be dumped. It will be understood that such outriggers may also be provided for the first embodiment of my invention hereinbefore described.

In both embodiments of my invention the empty cradle 37 must be tilted when trailer 15 or trailer 60 is backed around a slag pot to pick it up, as otherwise the inside end of rear side member 39 will strike the upper edge of the pot.

In the foregoing specification I have described presently preferred embodiments of my invention; however, it will be understood that my invention can be otherwise embodied within the scope of the following claims.

I claim:

1. Roadway vehicle apparatus for transporting and dumping a slag pot provided with trunnions comprising a lowboy vehicle having a wishbone-type frame open at the rear so that the vehicle can be backed to enclose within the frame a slag pot standing on the ground, a track affixed to the frame crosswise thereof and elevated therefrom, a trolley mounted on the track provided with means for lifting a slag pot from the ground by its trunnions, means attached to the trolley for moving the trolley on the track, a cradle for the slag pot attached to the frame tiltable about a horizontal axis disposed normal to the track at one end thereof and elevated above the frame, means positioned below the cradle connected with the frame for tilting that cradle so that it dumps the slag pot over the frame broadside thereof, and means attached to that cradle adapted to receive the slag pot trunnions from the trolley lifting means when the cradle is upright, the slag pot lifting means and the slag pot receiving means having side openings facing each other whereby transfer of the slag pot from the former to the latter is initiated through lateral movement of the slag pot into the cradle.

2. Apparatus of claim 1 in which the slag pot lifting means comprise a pair of depending hooks and the slag pot receiving means comprise a pair of upstanding hooks.

3. Apparatus of claim 2 in which the slag pot lifting hooks are deeper than the slag pot receiving hooks so that the slag pot lifting hooks can be withdrawn after the slag pot trunnions are transferred to the slag pot receiving hooks.

4. Apparatus of claim 2 in which the respective slag pot lifting hooks and the respective slag pot receiving hooks are offset from each other longitudinally of the vehicle.

5. Apparatus of claim 1 in which the cradle is provided with a downwardly projecting lug inboard of its slag pot receiving means and the means for tilting the cradle comprise a hydraulic cylinder and piston pivotally connected at one end with the track below the tilting axis of the cradle and intermediate that axis and the lug when the cradle is upright and at the free end bears against the downwardly projecting lug.

6. Apparatus of claim 5 in which the hydraulic cylinder and piston are affixed to turn the cradle from its upright position to a limiting position at which the center of gravity of the cradle and loaded pot is outside the cradle axis and then to disengage therefrom.

7. Apparatus of claim 5 including means for restraining the cradle comprising a cable connected at one end to the cradle inboard of its tilting axis, and means for extending or retracting the cable connected with the frame and with the other end of the cable whereby tilting of the cradle beyond the position at which the center of gravity of the cradle and slag pot is outside the cradle axis is restrained.

8. Apparatus of claim 7 including block and tackle apparatus through which the cable is threaded so as to reduce the travel of the extending or retracting means.

* * * * *

UNITED STATES PATENT AND TRADEMARK OFFICE

CERTIFICATE OF CORRECTION

PATENT NO. : 4,168,930

DATED : September 25, 1979

INVENTOR(S) : GIBSON E. BROCK

It is certified that error appears in the above-identified patent and that said Letters Patent are hereby corrected as shown below:

Column 1, line 37, "layouts" should be --layout--.

Column 4, line 30, --the-- should be inserted before "lower ends".

Signed and Sealed this

*Fourth* Day of *December 1979*

[SEAL]

*Attest:*

SIDNEY A. DIAMOND

*Attesting Officer*

*Commissioner of Patents and Trademarks*